US006804886B2

(12) United States Patent
Wain

(10) Patent No.: US 6,804,886 B2
(45) Date of Patent: Oct. 19, 2004

(54) SAFETY RAZORS

(75) Inventor: Kevin J. Wain, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 10/377,279

(22) Filed: Feb. 28, 2003

(65) Prior Publication Data

US 2003/0204954 A1 Nov. 6, 2003

Related U.S. Application Data

(63) Continuation of application No. PCT/US01/31604, filed on Oct. 11, 2001.

(30) Foreign Application Priority Data

Oct. 16, 2000 (GB) ..... 0025339

(51) Int. Cl.[7] ..... B26B 21/56
(52) U.S. Cl. ..... 30/49; 30/50; 30/346.55
(58) Field of Search ..... 30/49, 50, 346.55

(56) References Cited

U.S. PATENT DOCUMENTS

| | | | | | |
|---|---|---|---|---|---|
| 1,013,034 | A | * | 12/1911 | Marx | 30/346.55 X |
| 2,247,661 | A | * | 7/1941 | Moskovics et al. | 30/346.55 X |
| 2,555,214 | A | * | 5/1951 | Wallach et al. | 30/346.55 X |
| 2,598,711 | A | * | 6/1952 | Musso | 30/49 |
| 3,514,856 | A | * | 6/1970 | Camp et al. | 30/346.555 X |
| 3,938,250 | A | * | 2/1976 | Perry | 30/50 X |
| 4,302,876 | A | | 12/1981 | Emmett | 30/47 |
| 4,621,424 | A | | 11/1986 | Jacobson | 30/41 |
| 4,939,840 | A | * | 7/1990 | Butka | 30/50 X |
| 4,976,028 | A | * | 12/1990 | Chen | 30/49 |
| 5,010,646 | A | * | 4/1991 | Neamtu | 30/50 |
| 5,201,253 | A | * | 4/1993 | Lazarchik et al. | 30/49 X |
| 5,666,729 | A | * | 9/1997 | Ferraro | 30/50 |
| 5,933,959 | A | * | 8/1999 | Sferruzza, Jr. | 30/50 X |
| 6,173,498 | B1 | * | 1/2001 | Warrick et al. | 30/50 |

FOREIGN PATENT DOCUMENTS

| | | |
|---|---|---|
| WO | 9509071 | 4/1995 |
| WO | 9838017 | 9/1998 |

* cited by examiner

*Primary Examiner*—Charles Goodman
(74) *Attorney, Agent, or Firm*—Ladas & Parry

(57) ABSTRACT

A safety razor blade unit (2) has blade assembly (5) comprising a plurality of parallel blades (16) mounted on a razor handle (1) by a flexible support structure (4). Each blade (16) consists of an elongate blade element having a forward edge section (50) with a sharp cutting edge (17), and a planar blade section (54) extending rearwardly from the forward edge section (50). The forward edge section is upwardly inclined by bending a blade element blank between press tooling so that in the transition region between the forward edge section (50), which extends back from the tip of the cutting edge (17) by not more than 1 mm, and the planar blade section (54), the lower surface is convex and the upper surface is concave, with the plane (Pt) bisecting the tip being at an angle of 10° to 35° to the mid plane (Pm) of the planar section (54). The blade 16 is positioned in the blade unit (2) with the mid plane (Pm) of the planar section parallel to a tangent plane tangential to surfaces of the guard (26) and the cap (24) of the blade unit. The tip of the cutting edge is at a height of 0.05 to 0.15 mm above the plane (Pn) of the upper surface at the planar section, and to ensure good flexibility the blade cross section has a minimum second moment of inertia not greater than $1.0\times10^{-4}$ mm$^4$.

21 Claims, 9 Drawing Sheets

17
16
18
17
5
15
19
25
21
12
22
23
6
9
12
4
7
14
10
20
8

$I_{min} = 0.322 \times 10^{-4} mm^4$ $I_{min} = 0.145 \times 10^{-4} mm^4$

SAFETY RAZORS

CROSS-REFERENCE TO RELATED APPLICATIONS

This application is a continuation of PCT/US01/31604 filed on Oct. 11, 2001.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention is concerned with safety razors of the kind in which a blade unit assembly is carried by a handle and includes at least one blade with a sharp cutting edge which is moved across the surface of the skin being shaved by means of the handle. A blade unit may be mounted detachably on a razor handle to enable the blade unit to be replaced by a fresh blade unit when the blade sharpness has diminished to an unsatisfactory level, or it may be fixedly attached to the handle with the intention that the entire razor be discarded when the blade or blades have become dulled. Detachable and replaceable blade units are commonly referred to as shaving cartridges. The present invention is particularly concerned with the blades of safety razor blade units, and relates specifically to elongate blades having cutting edges which extend along the blades.

(2) Description of Related Art

Safety razor blade units generally include, in addition to the at least one blade, a guard which defines a surface for contacting the skin ahead of the blades as the blade unit is moved across the skin in the performance of a shaving stroke, and a so-called cap defining a surface for contacting the skin behind the blade(s). It is well known that to achieve the best possible performance the or each blade must be orientated with respect to the cap and guard surfaces so that it is inclined to a plane which is tangential to those surfaces (the "tangent plane"). By the blade being inclined it is meant that the mid-plane of the sheet material of the blade, which plane bisects the angle defined between the edge facets that form the cutting edge at the blade tip, is at an angle, sometimes called the "blade tangent angle", to the tangent plane. A blade can be fixed in position so that the blade tangent angle does not vary to any significant extent when the razor is being used, but it is also known to mount blades movably within the frame so that their blade tangent angles may change as a consequence of blade movements in the performance of a shaving stroke. In either case it has been the prior practice to support the or each blade in safety razor blade units so that a substantially planar blade element which includes the cutting edge and a blade section extending back from the faceted edge for at least several millimeters, lies at an appropriate angle to the tangent plane. In one well known construction planar blade elements are mounted on bent blade supports which have a forwardly and upwardly inclined portion on which the blade elements are carried, and upright rear portions which are slidably guided. in the frame in which the blades are mounted. The need to set the blade tangent angles by correct positioning of the blades during blade unit assembly is inconvenient and has a tendency to complicate the construction of the blade units as well as the assembly procedures themselves. Furthermore, in modern safety razors it is common to have two or three blades with parallel edges, and having a plurality of such blades lying in respective planes inclined to the tangent plane can inhibit blade unit flexibility should that be desired.

There have been proposals for safety razors with blade elements having circular cutting edges which extend around holes in the elements. Examples of such safety razors are those described in U.S. Pat. Nos. 5,201,253 and 5,490,329. Unlike a straight-edged blade, the blade elements with circular cutting edges can not be inclined to the sharpened edge at a desired angle and position with respect to the skin during shaving. Therefore, these blade elements need to be made to ensure the required shape and inclination of the edges, such as by special grinding techniques as taught by U.S. Pat. No. 5,490,329, and/or the required shape can be imparted to the circular edges by deforming the edges after sharpening, as described in U.S. Pat. No. 5,201,253. These proposals have been addressed specifically to overcome problems inherent with blade elements with circular cutting edges, and they have no obvious application to blades with straight edges which do not present the same difficulties.

In U.S. Pat. No. 5,010,646 there is described a safety razor blade unit incorporating blades which are bent so that a cutting portion along which the sharpened edge extends is at an angle of about 112° to a base or guide portion, both portions also being corrugated for stress relieving purposes. Blades bent in this way have substantially reduced flexibility and do not offer any solution to the above mention drawbacks of the hitherto known planar blades.

There is described in U.S. Pat. No. 3,938,250 a composite blade assembly for a safety razor, which composite blade assembly includes a planar blade and a supplementary blade member fastened to the underside of the planar blade, the supplementary blade member being bent to increase the span between the cutting edges respectively provided on the planar blade and the supplementary blade member. Also, the blade tangent angle of the supplementary blade member is reduced by this, blade member being bent. The bent blade member is specifically adapted to the production of a composite tandem blade and it does not offer any obvious solution to the drawbacks of the known arrangements which limit flexibility by requiring the blades to be set at certain inclinations to provide the desired blade tangent angles.

With a blade of this form a relatively small tip section can be bent to achieve the desired blade tangent angle with the major part of the blade being substantially planar and lying parallel to the tangent plane, thereby enabling enhanced flexibility, especially in blade units equipped with multiple blades.

BRIEF SUMMARY OF THE INVENTION

The present invention has for its objective to eliminate, or at least substantially alleviate the limitations of the prior art blade arrangements. The invention is directed particularly to a blade for a safety razor blade unit, comprising an elongate blade element with upper and lower surfaces, a forward edge section having a sharp cutting edge extending therealong and defined by surface portions which taper towards the tip of the cutting edge, and a substantially planar blade section extending rearwardly from the edge section and over which the upper and lower surfaces are parallel, wherein in a transition region between the planar blade section and the forward edge section the lower surface has a convex curvature and the upper surface is non-convex and is preferably concave.

According to an aspect of the invention there is provided a blade of the form described above wherein, along at least most of the length of the blade, the blade cross-section has a minimum second moment of area not greater than $1.0\times 10^{-4}$ $mm^4$.

The second moment of area of the blade cross-section is dependent on the size and shape of the cross-section and is a measure of blade flexibility. Although flexibility is dependent on the Young's modulus of the blade material, razor blade materials currently used have Young's moduli close to one another so the second moment of area is a good indicator of blade flexibility. The second moment of area is measured with respect to an axis, and by the minimum second moment of area it is meant the moment of area determined with respect to that axis which results in the lowest value for that blade cross-section. It is preferable that the minimum second moment of area does not exceed $0.5\times10^{-4}$ $mm^4$ and blades having a minimum second moment area less than $0.35\times10-^{4}$ $mm^4$, and even less $0.20\times10-^{4}$ $mm^4$, e.g. around $0.14\times10^{4}$ $mm^4$ or lower are possible.

In accordance with another aspect the invention provides a blade of the form defined above wherein a plane bisecting the tip of the blade edge is inclined to the mid plane of the planar blade section at an angle in the range of 10° to 35°. With the forward edge section set at such an inclination an effective blade tangent angle can be assured with the planar blade section lying substantially parallel to the tangent plane. The angle between the tip bisector and the mid plane of the planar blade section is preferably in the range of 15° to 30°, and more especially 20° to 25°.

A blade in accordance with a further aspect of the invention has the forward edge section extending back from the tip of the cutting edge by a distance not greater than 1 mm, and preferably not greater than 0.5 mm.

According to a preferred embodiment the forward edge section extends back from the tip by a distance extending not substantially beyond the tapering surface portions, and in particular by a distance several times less, than the distance through which the planar section extends rearwardly from the forward section.

In accordance with the different aspects of the invention mentioned above, the blade element conveniently comprises a metal strip having a bend at the junction between the forward edge section and the planar blade section.

The invention also resides, in accordance with a further aspect, in a safety razor blade unit including a guard surface, a cap surface, and at least one blade comprising an elongate blade element with upper and lower surfaces, a forward edge section having a sharp cutting edge extending therealong and defined by surface portions which taper towards the tip of the cutting edge, and a substantially planar blade section extending rearwardly from the forward edge section and over which the upper and lower surfaces are parallel, wherein in a transition region between the planar blade section and the forward edge section the lower surface has a convex curvature and the upper surface is concave, whereby a plane bisecting the tip of the blade edge lies at an angle to a tangent plane that is tangential to the guard and cap surfaces greater than the angle of the mid plane of the planar blade section to the tangent plane.

The mid plane of the or each blade is preferably substantially parallel to the tangent plane that is tangential to the guard and cap surfaces. With the upper blade surface concave at the transition region, the tip of the cutting edge lies above the plane of the upper surface at the planar blade section. A preferred blade element has the edge tip at a height of up to 0.25 mm, in particular in the range of 0.05 mm to 0.15 mm, above the plane of the upper surface.

With a blade as provided by the invention, and the blade tangent angle can be effectively set during the production of the blades themselves. Furthermore, as the major part of each blade can be planar, two or more blades can be disposed in an essentially planar array enabling production of a blade assembly with substantially greater flexibility than hitherto attainable. The benefits of the invention are most marked when an upwardly inclined blade portion, at forward edge section is confined to a small region close to the cutting edge.

A plurality of blades, each in accordance with the invention as explained above, may be conveniently assembled into a blade assembly which can form a sub-unit for assembly with other components in the manufacture of a safety razor blade unit, the blades being so interconnected that their cutting edges are substantially parallel, and the planar sections of the blades are substantially coplanar. The blades can be conveniently interconnected by transverse strips attached to the undersides of the planar sections of the blades. These interconnecting strips may also serve to secure the blade assembly to a support structure of the blade unit.

In a safety razor blade unit incorporating the blades of the present invention it is advantageous if the planar sections of the blades are coplanar with, or lie in a plane parallel to, the tangent plane which is tangential to cap and guard surfaces defined by the blade unit. Such an arrangement enables maximum advantage to be taken from the blade flexibility that the invention makes available.

The blade of the invention can consist of a blade element comprising a metal, e.g. steel, strip having a bend at the junction between the forward edge section and the planar section. The blade material can be conventional and the cutting edge can comprise coatings as known in the art, including hard coatings, such as boron nitride, amorphous diamond or diamond-like-carbon, which coatings are preferably deposited before the blade element is bent near the tip although it would be possible for one or more coatings to be applied subsequent to bending of the blade element.

In accordance with yet another aspect of the invention, there is provided a method of making a blade according to the invention as described above, the method comprising the steps of:

providing a substantially planar elongate blade element blank having a sharp cutting edge extending therealong and defined by surface portions which taper towards the tip of the edge; and bending the blade element blank in a region not greater than 1 mm back from the tip of the cutting edge so that the tip of the cutting edge is displaced away from the initial plane of the blank.

During the bending operation the tip of the cutting edge is preferably displaced to a position above an upper surface plane of the blank, e.g. to a height of up to 0.25 mm, such as 0.05 to 0.15 mm above that plane.

In addition the invention resides in tooling for making blades according to the invention, the tooling comprising a first member having a flat pressing surface extended forwardly by an inclined ramp surface, and a second member having a flat pressing surface facing the flat pressing surface of the first member, the members being guided for movement of the flat surfaces towards and away from each other for pressing a blade element blank therebetween.

To inhibit unwanted movements of the blade element blank during pressing, a rear stop can be provided for abutment with the rear edge of the blade element blank and/or the ramp surface can be limited by a forward stop disposed for engagement by the front edge of the blade element blank during the pressing thereof.

The blades of this invention are of particular benefit when used in a safety razor blade unit having a resiliently compliant blade support structure, such a blade unit being described and claimed in our copending British Patent Application 0025336.9 and an International patent application claiming priority therefrom, and the contents of which are incorporated herein by reference.

BRIEF DESCRIPTION OF THE SEVERAL VIEWS OF THE DRAWINGS

A clear understanding of the invention will be gained from the following detailed description in which reference is made to the accompanying drawings in which.

DETAILED DESCRIPTION OF THE INVENTION

Figure 1:
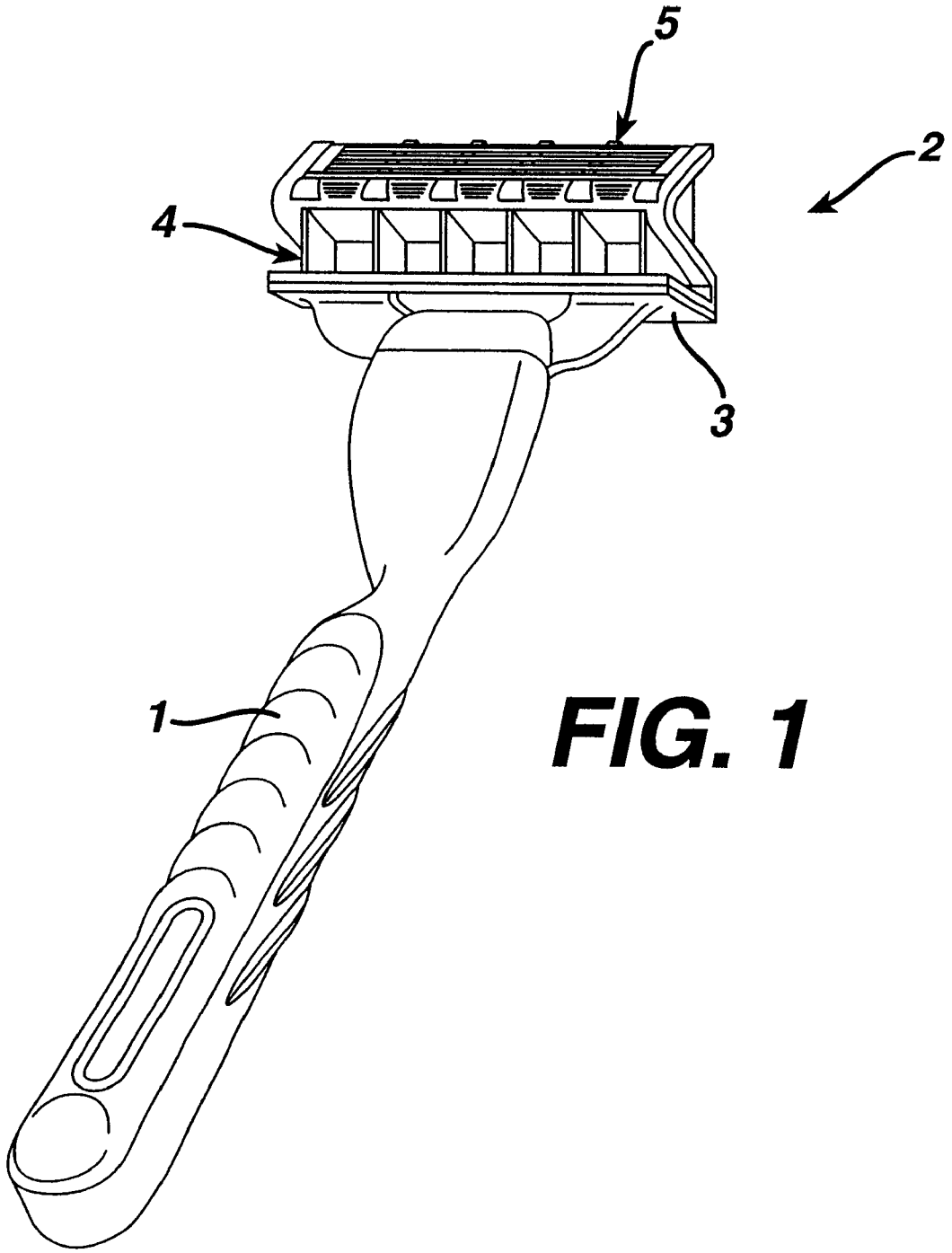
FIG. 1 shows a safety razor equipped with a blade unit having blades in accordance with the invention, in a front perspective view.
Figure 3:
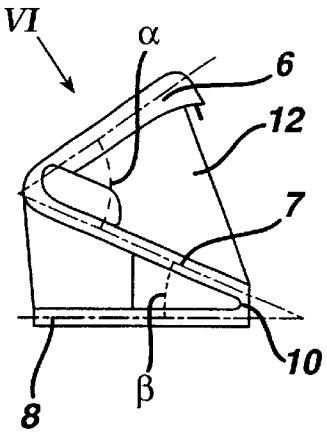
FIG. 3 is an end elevation of the blade unit.
Figure 2:
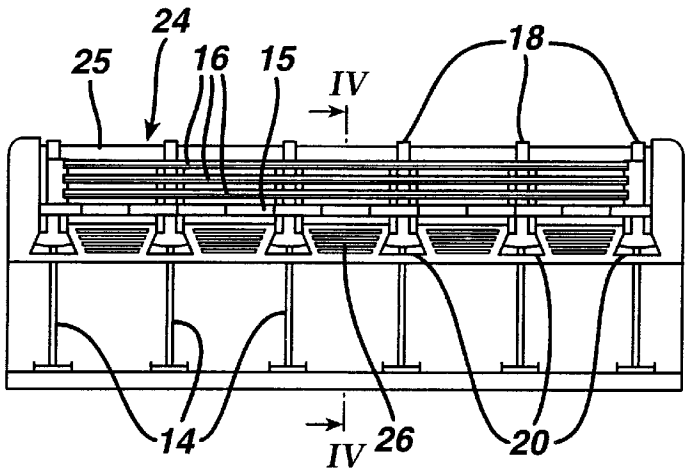
FIG. 2 is a front elevation of the blade unit of the razor shown in FIG. 1.
Figure 4:
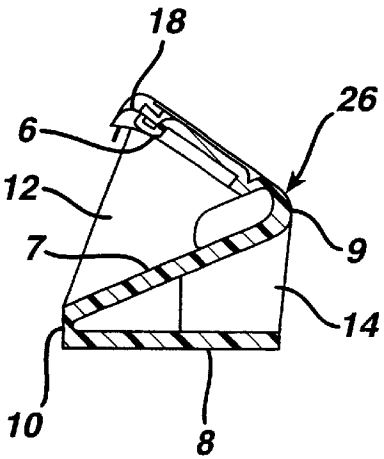
FIG. 4 is a cross section taken along the line IV—IV in FIG. 2.
Figure 5:
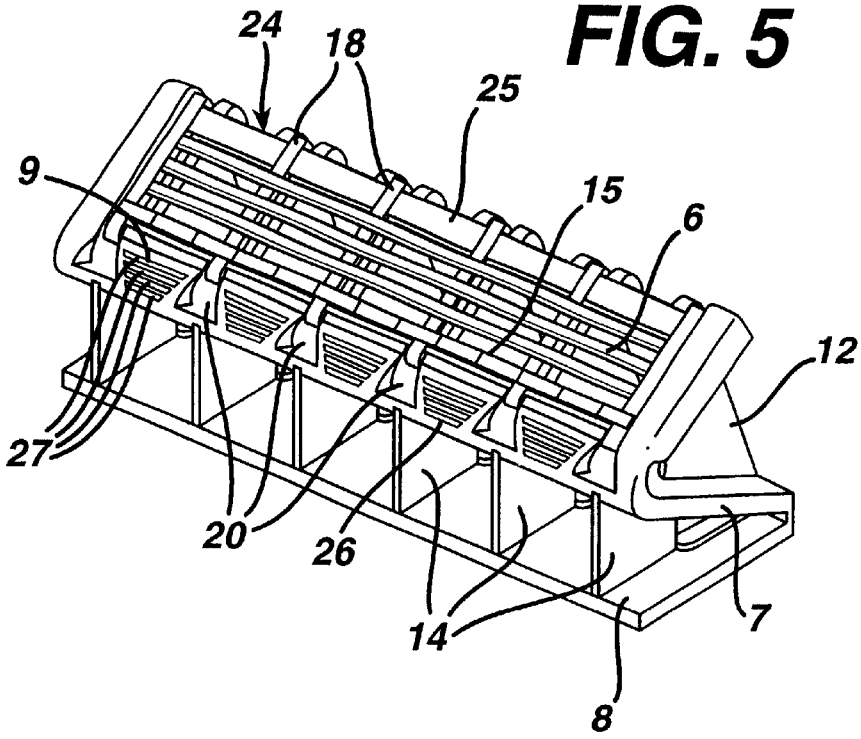
FIG. 5 is an isometric view of the blade unit.

The razor illustrated in FIGS. 1 to 11 and described below is also described and claimed in the aforementioned British Application No. 0025336.9 and the International Application claiming priority therefrom. The razor has a handle 1 on which a blade unit 2 is mounted. As shown the handle 1 has a fixed support platform 3 to which the blade unit 2 is securely fastened, but the blade unit 2 could equally well be releasably connected to the handle 1 to allow replacement of the blade unit 2. The blade unit 2 comprises a support structure 4 on which a blade assembly 5 is carried. The support structure 4 consists of a unitary moulding of rubber, or a material having similar resiliently flexible properties to those of rubber, and includes an upper frame 6 on the upper face of which the blade assembly 5 is positioned, a sub-frame 7 which has the form of a substantially planar sheet, and a base 8 which can also have the form of a substantially planar sheet. The upper frame 6 and the sub-frame 7 are connected by a living hinge 9 at their forward edges and are relatively positioned normally to diverge from each other rearwardly away from the hinge 9. The sub frame 7 and base 8 are similarly connected by a living hinge 10 at their rear edges and are disposed normally to diverge from each other in the direction forwardly away from the hinge 10. With this configuration the upper frame 6, sub-frame 7 and base 8, as viewed in end elevation (FIG. 3), or transverse cross-section (FIG. 4) define a Z shape, but with the angle $\alpha$ subtended between the upper frame 6 and the sub-frame 7 being greater than the angle $\beta$ subtended between the sub-frame 7 and the base 8 so that the upper frame 6 is normally set at an appropriate angle with respect to the stem of the handle 1 and to ensure the desired deformation characteristics of the support structure 4 as explained below. Extending between and integrally interconnected with the upper frame 6 and the sub-frame 7 are several spaced flexible webs 12 uniformly distributed along the support structure 4. As shown there are six webs 12 although more or less than this number may be employed. The webs 12 normally lie in respective parallel planes perpendicular to the planes of the upper frame 6 and the sub-frame 7. The flexible webs 12 constitute respective spring elements and each is capable of deforming by buckling, to allow the portion of the upper frame 6 in the region of that web to be displaced towards the sub-frame 6 with the deformed or buckled web 12 exerting a substantially constant restoring force independent of the degree of buckling and hence the displacement of the upper frame 6. Since the webs 12 act independently of each other, different portions of the upper frame 6 along the length thereof may be readily displaced by different amounts towards the sub-frame 7.

The sub-frame 7 is similarly supported with respect to the base 8 by a series of six integral webs 14 uniformly spaced apart along the blade unit. Conveniently the webs 14 are aligned and coplanar with the webs 12. The webs 14 which can also deform by buckling serve as independent spring elements acting between the sub-frame 7 and the base 8, and they allow local displacement of the sub-frame 7 towards the base 8 and hence the handle 1, while exerting a substantially constant restoring force resisting such displacement. The resiliently flexible nature of the support structure 4 with the webs 12, 14 is such that localized portions of the upper frame 6 and the blade assembly 5 carried thereon can be deflected towards the razor handle 1 in order to adapt to the skin contours without necessarily influencing the dispositions of other portions thereof, and the upper frame 6 and the blade assembly 5 can as a consequence contort to comply with the undulations of the skin area over which they are moving. Thus, the blade unit is resiliently compliant to ensure close contact with the skin over the full area spanned by the blades.

Figure 8:
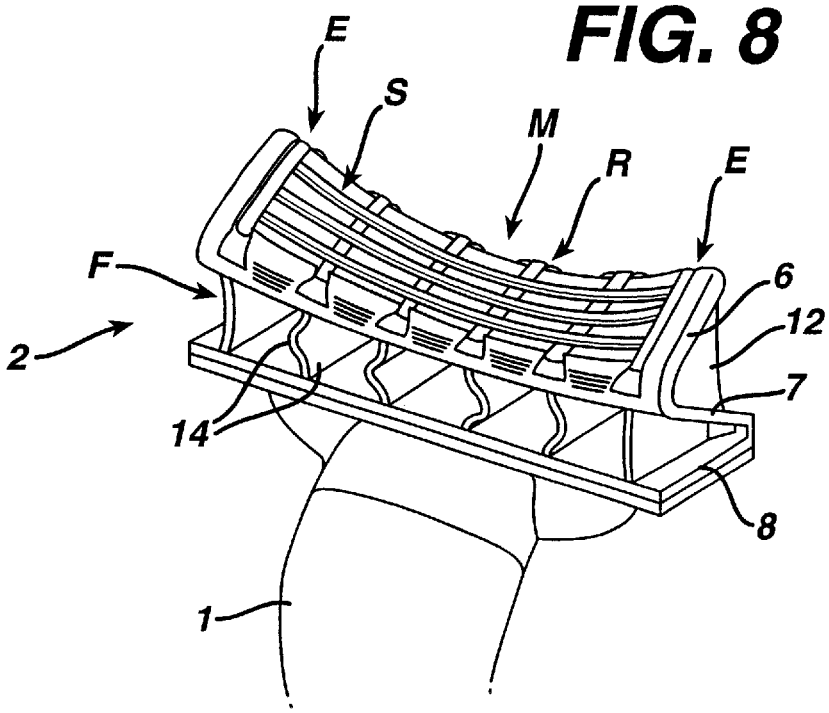
FIGS. 8 and 9 show the blade unit from the front and rear respectively, in a deformed condition as may arise during shaving.
Figure 9:
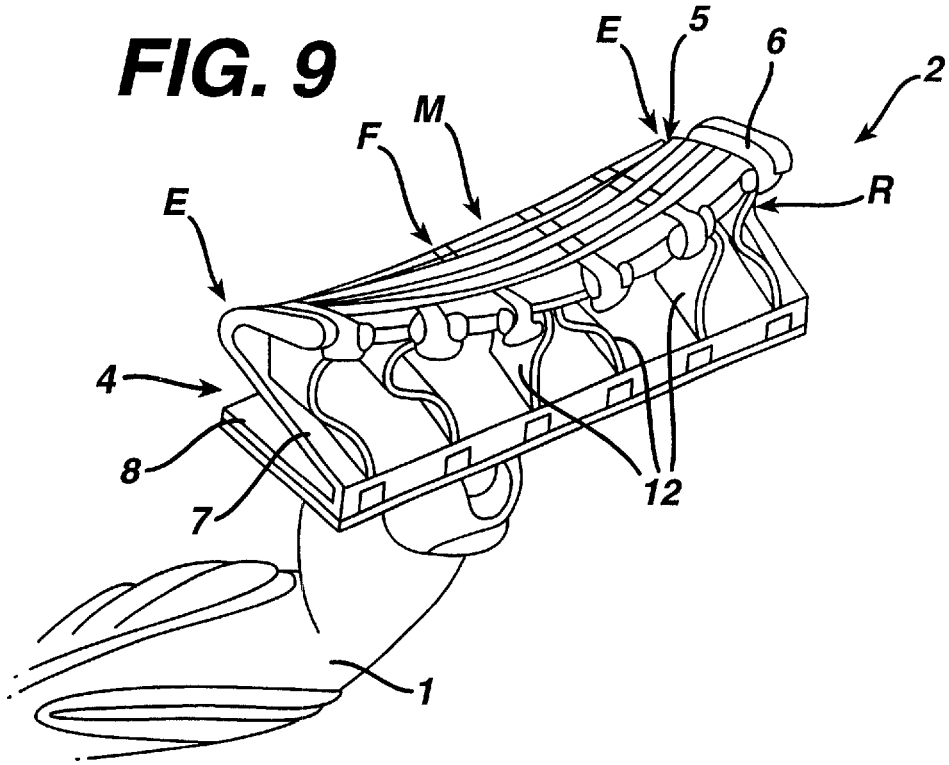
Figure 10:
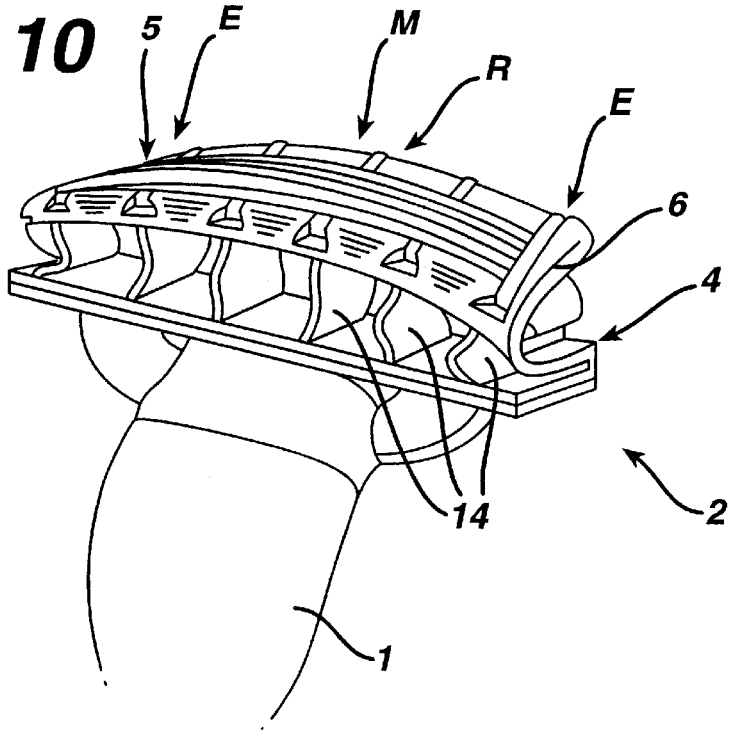
FIGS. 10 and 11 show the blade unit from the front and rear, respectively, in another deformed condition as may arise during shaving.
Figure 11:
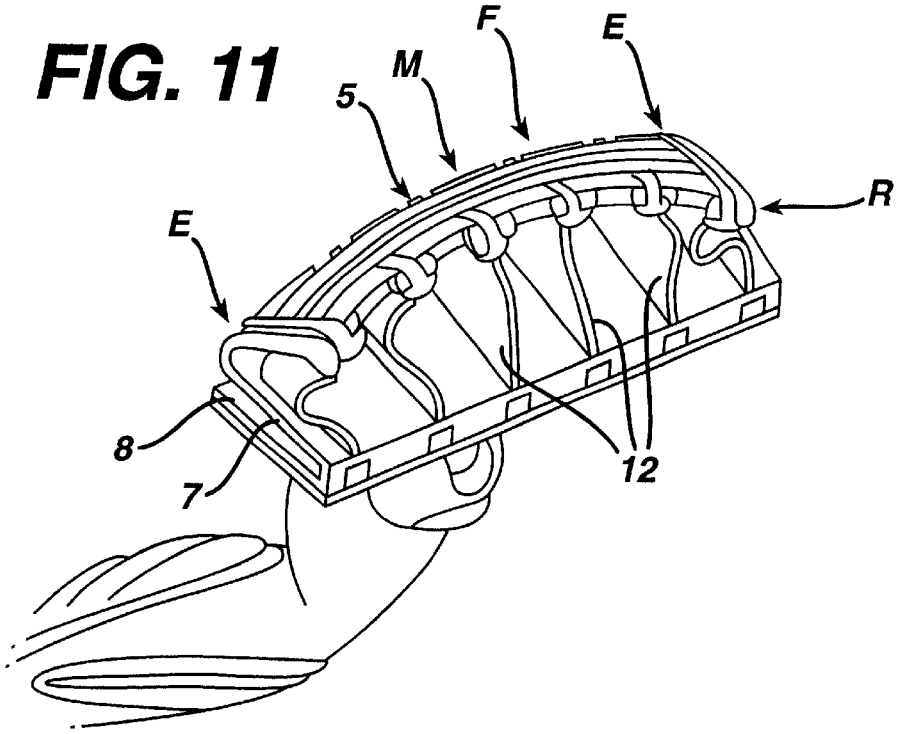

Thus, FIGS. 8 and 9 illustrate the blade unit 2 with the upper frame 6 and blade assembly 5 deformed into a concave form, their medial portions M being displaced towards the handle 1 by a greater amount than their end portions E with the webs 12, 14 towards the centre M of the blade unit being buckled to a greater extent than those webs 12, 14 located nearer the ends E of the blade unit 2. FIGS. 10 and 11 on the other hand show the blade unit 2 deformed into a convex configuration, the blade assembly 5 and upper frame 6 being displaced downwardly towards the handle 1 by a greater amount at the ends E of the blade unit than at the central portion M of the blade unit, and in this case the webs 12, 14 towards the ends E of the blade unit 2 being buckled more than those webs 12, 14 closer to the centre M of the blade unit 2. Although both sets of spring webs 12, 14 are shown buckled in FIGS. 8 to 11 this is not inevitable or essential. It is possible, for example as a result of downward shaving force applied towards the rear R of the blade unit for the webs 12 to buckle so that the upper frame 6 and blade assembly 5 are displaced downwardly adjacent the rear edge R without the webs 14 buckling and without any displacement of the upper frame 6 and the blade assembly 5 at their front edge F. Also a force applied near the front edge can cause downward displacement of the upper frame 6 and blade assembly at their front edge F due to the webs 14 buckling without the webs 12 becoming buckled. As a consequence the upper frame 6 and blade assembly 5 are compliant both in the direction longitudinally of the blade unit and in the direction perpendicular thereto in order to adapt to conform closely to the contours of a skin area being shaved. Because the angle $\alpha$ subtended between the upper frame 6 and the sub-frame 7 is greater than the angle $\beta$ subtended between the sub-frame 7 and the base 8, the webs 12 are somewhat longer and correspondingly weaker than the webs 14, whereby the webs 14 exert a greater resistance to downward displacement of the upper frame 6 and the blade assembly 5 at their front edge F than the resistance to downward displacement exerted by the webs 12 at the rear edge R of the upper frame 6 and blade assembly 5, which characteristic is considered desirable as during shaving greater forces are generally imparted to a blade unit in the region of the guard than those exerted in the region of the cap.

Figure 6:
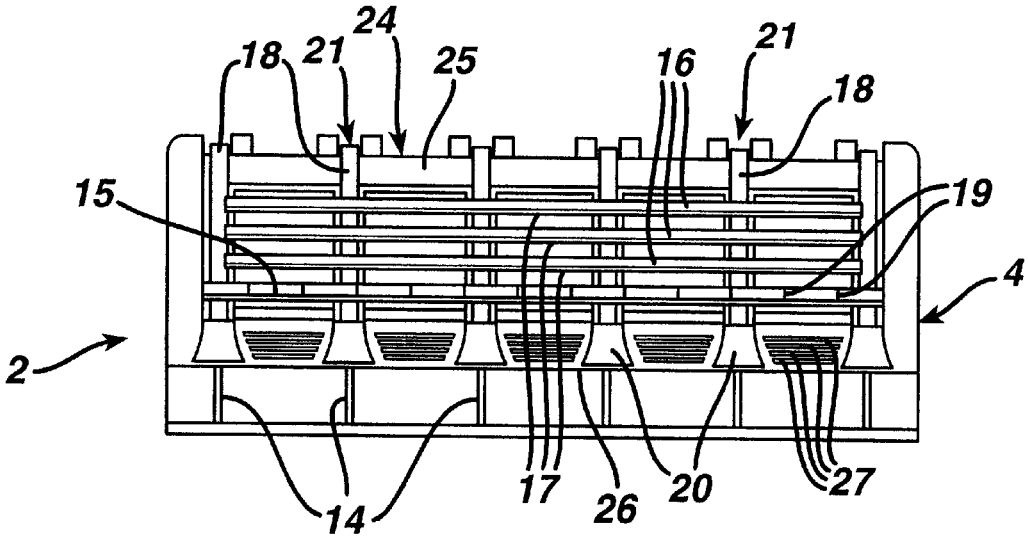
FIG. 6 is a view showing the blade unit as seen in the direction of the arrow VI in FIG. 3.
Figure 7:
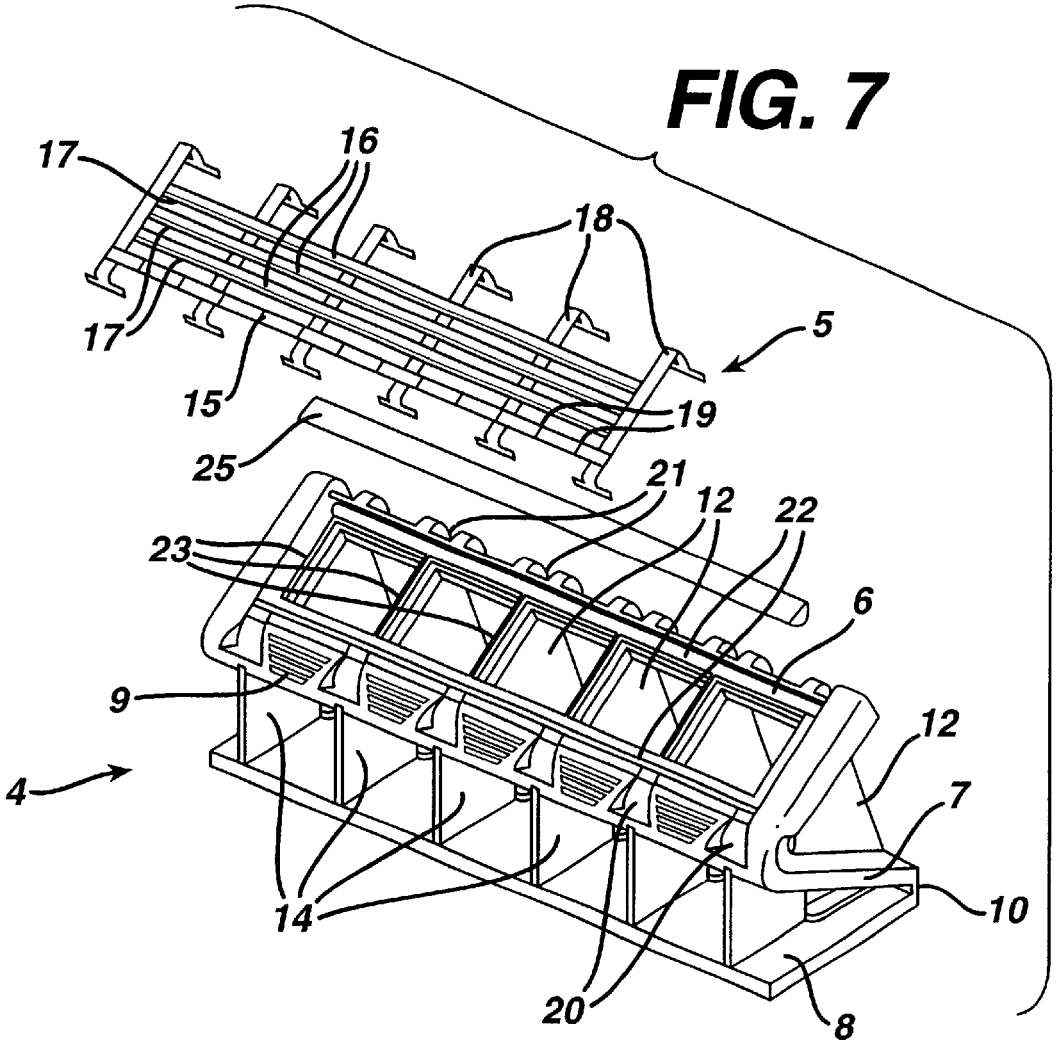
FIG. 7 is an exploded isometric view of the blade unit.

The blade assembly 5 comprises a guard member 15 and a plurality of elongate blades 16, the guard member 15 and the blades 16 being formed by flexible strips of metal, and the blades 16 having parallel forwardly facing sharpened edges 17. The guard member 15 and the blades 16 are interconnected by transverse strips 18 which are attached to the undersides of the blades and guard member 15. Maximum flexibility of the blade unit is ensured by the blades 16 and transverse connecting strips 18 being coplanar in the normal, undeformed condition of the blade assembly 5 and the blade unit 2. The guard member 15 is also substantially coplanar with the blades 16 and connecting strips 18 although as shown in FIGS. 6 and 7, this guard member 15 has an upwardly inclined rear portion, and slits 19 are spaced along the length of this portion of the guard member 15 to enhance the flexibility of this member. Including the guard member 15 in the blade assembly can be advantageous in reliably defining the shaving geometry of the blades, and the first blade in particular. The strips 18 have turned-down T-shaped ends which are engaged with notches 20, 21 moulded in the front and rear edges of the upper frame 6 in order to secure the blade assembly 5 to the support structure. The upper frame 6 includes longitudinal frame members 22 at the front and rear and transverse frame members 23 to which the upper edges of the webs 12 are attached. In the assembled blade unit 2 the strips 18 of the blade assembly 5 extend above respective frame members 23. The cap 24 of the blade unit 2 includes a flexible lubricating strip 25 which sits in a groove extending along the rear longitudinal member 22 of the upper frame 6 and is held in place by the transverse strips 18 of the blade assembly. The support structure 4, at the front of the upper frame 6 in the region of its hinged connection to the sub-frame 7, forms a guard 26 which has longitudinal ribs 27 moulded thereon although protrusions of other configurations could be provided. Also, if preferred, a separate flexible guard element could be mounted on the support structure to provide a desired guard configuration.

Figure 12:
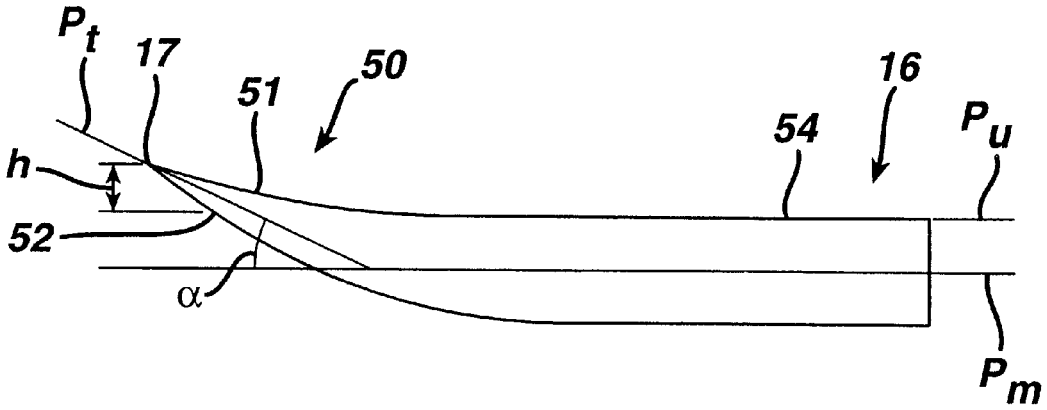
FIG. 12 is a cross section through a blade of the blade unit, the blade being in accordance with the present invention.
Figure 13A:
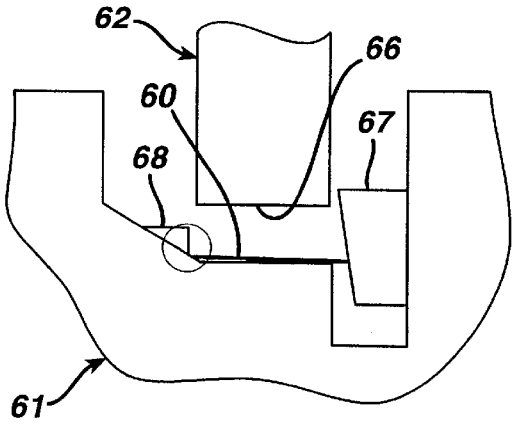
FIGS. 13A, 14A and 15A are schematic illustrations showing successive stages in shaping the blade of FIG. 12 by a pressing operation.
Figure 13B:
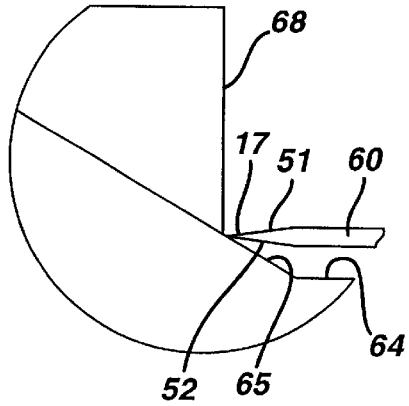
FIGS. 13B, 14B and 15B are enlarged scale views of the circled areas of FIGS. 13A, 14A and 15A, respectively.
Figure 14A:
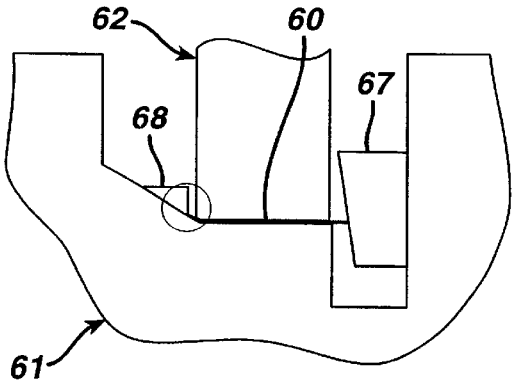
Figure 14B:
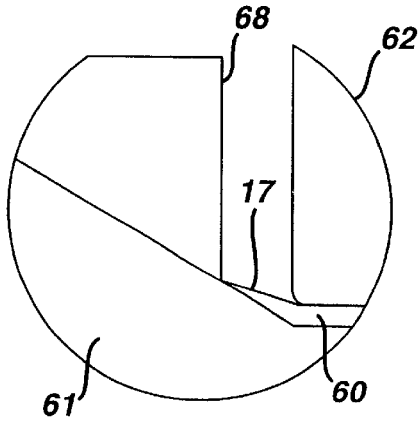
Figure 15A:
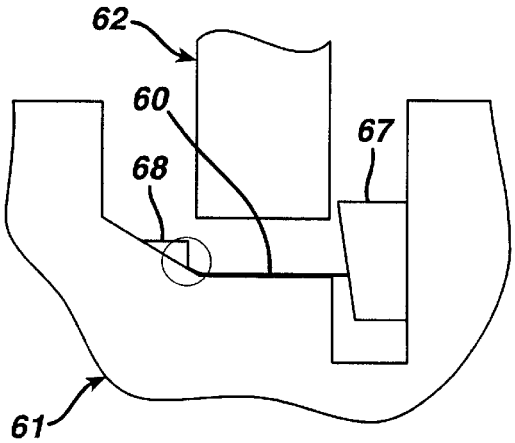
Figure 15B:
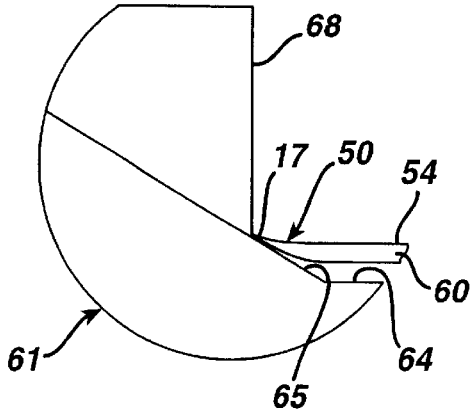

In accordance with the present invention each of the blades 16 comprises an elongate blade element with a forward edge section 50 (FIG. 12) forming the sharp cutting edge 17, the tip of this edge being confined between opposed surface portions 51, 52 referred to hereinafter as facets which taper towards the tip, and a substantially planar blade section 54 extending rearwardly from the forward edge section 50. The forward edge section 50 is canted upwardly towards the tip of the cutting edge 17 so that a plane $P_t$ bisecting the angle between the facets 51, 52 at the tip of the cutting edge is inclined at an angle $\alpha$ of around 20° to 25° to the plane $P_m$ of the planar section 54. The tip of the cutting edge 17 is can be positioned above the plane Pu of the upper surface at the planar section at a height of up to 0.25 mm, preferably a height in the range of 0.05 to 0.15 mm. The inclination of the canted forward section 50 is obtained by bending a planar blade element, blank 60 as illustrated in FIGS. 13A, 14A and 15A, by pressing the blade element blank 60 in a tooling assembly comprising a lower first member 61 and an upper second member 62. The lower tool member 61 defines a flat pressing surface 64 which is extended forwardly by a ramp surface 65. The upper tool member 62 has a flat pressing surface 66 which confronts the flat pressing surface 64 of the lower member 61, and the upper member 62 is movable relative to the lower member 61 for pressing a blade element blank 60 between the flat pressing surfaces. The lower member 61 has a rear stop 67 for abutting the rear edge of a blade element blank 60 and a front stop 68 located on the ramp surface 65 for abutment with the tip of the blade edge. The stops 67, 68 may be adjustable to suit the width of the blade element blanks 60 to be pressed, and to adjust the position of the bend to be produced with respect to the tip of the blade edge 17, the rear stop 67 being adjustable vertically and having an inclined front face for this purpose.

An elongate planar blade element blank 60 with a finished cutting edge 17 along its forward edge is introduced between the upper and lower tool members 61, 62, and is brought to rest against the flat surface 64 of the lower member with its rear edge in contact with the rear stop 67 and the tip of the cutting edge 17 resting on the ramp surface 65 and against the front stop 68 (FIGS. 13A and B). The blank is therefore initially tilted at a small angle to the flat surface 64. The upper member 62 is then driven downwardly bringing its pressing surface 66 into contact with the blank 60 and causing the portion of the blank 60 between the surfaces 61, 66 to be pressed flat against the surface 64, and hence the forward edge section 50 of the blade to be pulled down against the ramp surface (FIGS. 14A and B). In one example the facets 51, 52 of the blade edge extend back from the edge tip by 0.3 mm, the blade thickness being 0.08 mm and, the front edge of the upper tool is aligned to contact the blade at a distance of 0.4 mm from the tip. When the upper member 62 is raised again, the bend produced in the blade blank 60 by the pressing operation recovers a little, but a permanent set in the blade blank 60 remains so that the forward edge section 50 is canted at the desired inclination with respect to the planar blade section 54 which extends rearwardly from it, and in a transition region between the forward section and planar section the lower surface has a convex curvature whereas the upper surface is non-convex, and more particularly concave. After completion of the blade shaping operation as described, a part of the blank including the canted forward edge section and a planar section several times wider, in the front to rear direction, than the canted forwarded edge section can be severed or snapped away from the blank to provide a flexible blade strip 16 of the desired width. The blades produced in this manner can then be used to produce blade assemblies as incorporated in the safety razor of FIGS. 1 to 11.

The blades 16 of the invention; manufactured as described above, are characterized by a relatively high flexibility despite their being bent to raise the tip and incline the cutting edge 17 to obtain an effective blade tangent angle with the planar section 54 of the blade positioned parallel to the tangent plane. The flexibility can be conveniently expressed by the second moment of area of the blade cross section since razor blade materials currently used have Young's moduli which differ little from one another. The second moment of area I of a cross sectional area with respect to an axis X lying in the plane of the cross section is the sum of the products obtained by multiplying each element of area dA by the square of its distance y from the axis X. Thus:

$$T=\int y^2 dA$$

It will be appreciated that the second moment of area is dependent on the shape and size of the cross section.

Figure 16A:
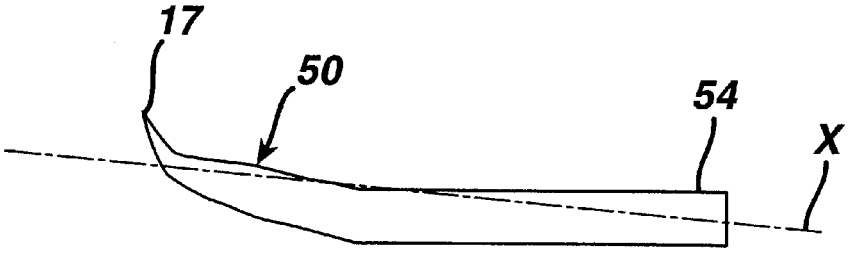
FIGS. 16A and 16B are cross sections through two blades indicating the axis with respect to which the second moment of area is at a minimum.
Figure 16B:
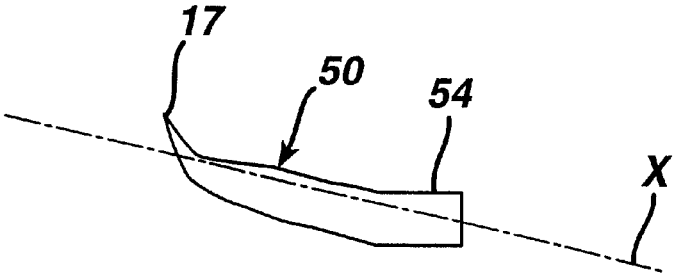

The minimum second moment area is the second moment of area measured with respect to that axis X which results in the smallest value for the second moment of area $I_{min}$- illustrated in FIGS. 16A and 16B are the cross sections, taken in planes perpendicular to the length of the cutting edges, of two blades 16 in accordance with the invention. The blade 16 of FIG. 16A is 0.08 mm thick and 0.80 mm wide with the planar section 54 being 0.40 mm wide, and its minimum second moment of area $I_{min}$ with respect to the axis X is $0.322\times10^{-4}$ $mm^4$. The blade of FIG. 16B has a thickness of 0.08 mm and a width of 0.80 mm with the planar section 54 being 0.10 mm wide, and in this case the minimum second moment of area is $I_{min}$ $0.145\times10^{-4}$ $mm^4$. As described above, the blades 16 of the invention are preferably positioned in a blade unit 2 with the mid planes of their planar sections 54 substantially parallel to the tangent plane tangential to the guard 26 and cap 24 surfaces of the blade unit, and the second moments of area I measured about axis parallel to these mid planes and intersecting the centres of area for the blades shown in FIGS. 16A and 16B have values of $0.443\times10^{-4}$ $mm^4$ and $0.263\times10^{-4}$ $mm^4$, respectively. To achieve a desired level of blade flexibility in an assembled blade unit 2, it is also referred that the second moment of area with respect to an axis passing through the centre of area and parallel to the mid plane of the planar section 54 is not greater than $1.0\times10^{-4}$ $mm^4$, and more especially not greater than $0.5\times10^{-4}$ $mm^4$. If the blade 16 has a cross section which is constant along its length the I values given above will apply at every position along the length. However, there may be short blade sections where the I values are different, because the cross section is different, and the desired flexibility can be assured by the blade having a form such that the specified I values apply along at least most of the length of the blade.

Although the invention has been described above in connection with shaping a blade having edge facets which, prior to bending of the blade, are symmetrical with respect to the centre plane of the blade, this is not essential and the blade edge could have an initial asymmetrical form including a so-called chisel edge in which the tip lies at the top surface plane of the blade.

Modifications to the specifically described embodiments are of course possible without departing from the principles of the invention and will occur to those skilled in the art. It is to be understood, therefore, that the particular embodiments described above are given by way of non-limiting example only and it is the intention that the scope of the invention should be limited only by the claims which follow.

What is claimed is:

1. A blade for a safety razor blade unit, comprising an elongate blade element with upper and lower surfaces, a forward edge section having a sharp cutting edge extending therealong and defined by surface portions which taper towards the tip of the cutting edge, and a substantially planar blade section extending rearwardly from the forward edge section and over which the upper and lower surfaces are parallel, wherein in a transition region between the planar blade section and the forward edge section the lower surface has a convex curvature and the upper surface is non-convex, and characterized in that along at least most of the length of the blade, the blade cross element section has a minimum second moment of area not greater than $1.0\times10^{-4}$ $mm^4$.

2. A blade according to claim 1, wherein the minimum second moment of area is not greater than $0.5\times10^{-4}$ $mm^4$.

3. A blade according to claim 2, wherein the minimum second moment of area is not greater than $0.35\times10^{-4}$ $mm^4$.

4. A blade according to claim 1, wherein a plane bisecting the tip of the blade is inclined to a mid plane of the planar blade section at an angle of inclination in the range of 10° to 35°.

5. A blade according to claim 4, wherein the angle of inclination is in the range of 15° to 30°.

6. A blade according to claim 5, wherein the angle of inclination is in the range of 20° to 25°.

7. A blade according to claim 1, wherein the forward edge section extends back from the tip of the cutting edge by a distance not greater than 1 mm.

8. A blade according to claim 7, wherein the forward edge section extends back from the tip of the cutting edge by a distance not greater than 0.5 mm.

9. A blade according to claim 1, wherein the forward edge section extends back from the tip of the cutting edge by a distance extending not substantially beyond the tapering surface portions.

10. A blade according to claim 1, wherein the forward edge section extends back from the tip of the cutting edge by a distance several times less than the distance through which the planar blade section extends rearwardly from the forward edge section.

11. A blade according to claim 1, wherein the upper surface is concave in the transition region and the tip of the cutting edge is above the plane of the upper surface at the planar blade section.

12. A blade according to claim 11, wherein the edge tip is at a height of up to 0.25 mm above the plane of the upper surface.

13. A blade according to claim 12, wherein the tip of the cutting edge is at a height in the range of 0.05 to 0.15 mm above the plane of the upper surface.

14. A safety razor blade unit comprising at least one blade as claimed in claim 1.

15. A safety razor blade unit according to claim 12, wherein the blade unit includes a guard surface and a cap surface, and the at least one blade is so positioned that a plane bisecting the tip of the blade cutting edge lies at an angle to a tangent plane tangential to the guard and cap surfaces greater than the angle of the mid plane of the planar blade section to the tangent plane.

16. A blade incorporated in a blade unit according to claim 14, wherein the edge tip is at a height of up to 0.25 mm above the plane of the upper surfaces.

17. A blade according to claim 1, wherein the blade element comprises a metal strip having a bend at a junction between the forward edge section and the planar blade section.

18. A safety razor blade unit including a guard surface, a cap surface, and at least one blade according to claim 1, whereby a plane bisecting the tip of the cutting edge lies at an angle to a tangent plane tangential to the guard and cap surfaces greater than the angle of the mid plane of the planar blade section to the tangent plane.

19. A safety razor blade unit according to claim 18, wherein the at least one blade is located with the planar blade section substantially parallel to the tangent plane.

20. A blade assembly for a safety razor comprising a plurality of blades each as defined in claim 1, wherein the blades are so interconnected that the cutting edges of the blades are substantially parallel, and the planar sections of the blades are substantially coplanar.

21. A blade assembly according to claim 20, wherein the blades are interconnected by transverse strips attached to undersides of the planar sections of the blades.

* * * * *

UNITED STATES PATENT AND TRADEMARK OFFICE

CERTIFICATE OF CORRECTION

PATENT NO. : 6,804,886 B2
DATED : October 19, 2004
INVENTOR(S) : Kevin J. Wain

It is certified that error appears in the above-identified patent and that said Letters Patent is hereby corrected as shown below:

Title page,
Item [63], Related U.S. Application Data, "31604" should read -- 31601 --.

Column 1,
Line 6, "31604" should read -- 31601 --.

Signed and Sealed this

Fourteenth Day of December, 2004

JON W. DUDAS
*Director of the United States Patent and Trademark Office*